US006475097B2

(12) United States Patent
Liao

(10) Patent No.: US 6,475,097 B2
(45) Date of Patent: Nov. 5, 2002

(54) STRUCTURE OF A GOLF PUTTER

(76) Inventor: Benjamin Liao, P.O. Box 82-144, Taipei (TW)

( * ) Notice: Subject to any disclaimer, the term of this patent is extended or adjusted under 35 U.S.C. 154(b) by 0 days.

(21) Appl. No.: 09/725,135

(22) Filed: Nov. 29, 2000

(65) Prior Publication Data

US 2002/0065141 A1 May 30, 2002

(51) Int. Cl.[7] ..... A63B 53/06

(52) U.S. Cl. ..... 473/248; 473/288; 473/306; 473/307

(58) Field of Search ..... 473/288, 306, 473/307, 245, 246, 247, 248, 296, 298, 299, 309

(56) References Cited

U.S. PATENT DOCUMENTS 1,601,770 A * 10/1926 Reach
2,171,483 A * 8/1939 Simonton
2,219,670 A * 10/1940 Wettlaufer
5,137,275 A * 8/1992 Nelson
5,533,725 A * 7/1996 Reynolds
5,765,691 A * 6/1998 Hall
5,863,260 A * 1/1999 Butler
5,885,170 A * 3/1999 Takeda
6,110,055 A * 8/2000 Wilson

* cited by examiner

*Primary Examiner*—Stephen Blau
(74) *Attorney, Agent, or Firm*—Leong C. Lei

(57) ABSTRACT

An improved structure of a golf putter comprising a shaft, an actuating seat having a threaded section, a fastening member and a club head, characterized in that the actuating seat has a top end provided with a holding hole of an appropriate depth to accommodate the shaft at the bottom end thereof, the lower end of the actuating seat is the threaded section to securely mount with the club head, the actuating seat has a center through hole and the fastening member is provided to the actuating seat so as to conveniently secure the seat to the fastening member, the fastening member passes through the through hole of the actuating seat and is mounted to the screw hole of the shaft, the club head has a hole which can be associated with the fastening member of the actuating seat so that the club head is mounted onto the actuating seat, thereby, the shaft, the actuating seat and the fastening member are formed integrally into an unit, the fastening member secures this unit together with the club head, by loosening the fastening member, the relative position of the shaft with respect to the actuating seat can be adjusted, that is, the relative angle of the club head and the shaft can be adjusted and then re-tightened the fastening member, and the function of the club head is changed.

1 Claim, 14 Drawing Sheets

STRUCTURE OF A GOLF PUTTER

BACKGROUND OF THE INVENTION (a) Technical Field of the Invention

The present invention relates generally to a golf club, especially a golf putter, and in particular, a golf club wherein the club head can be changed and its relative angle with the grip of the club can be adjusted.

(b) Description of the Prior Art

Structure of conventional golf club is shown in FIG. 1, wherein the club has an elongated shaft 10 having a treaded section at one end. The threaded section allows the mounting of a club head 30 having being provided with another threaded section at one end thereof. The top end of the shaft 10 is mounted with a grip 20 for holding.

Referring to FIG. 2, the grip 20 of the putter (club) is not round to allow convenient holding of the club. However, in general, the grip 20 has a flat surface 21 and in combination, the flat surface 21 has to be parallel to the club head 30, which is shown in FIG. 2. Thus, this structure allows accurate holding and provides better swing in putting a golf ball. However, this structure has the following drawbacks:

Conventional shaft and the club head are normally not changeable. Generally, the club head 30 has about 30 designs, and in order to meet the requirement of parallel structure between the grip 20 and the club head 30, the club head 30 and the shaft 10 have to be mounted first. This is because the final fixing angle of the club head 30 with the shaft 10 cannot be determined. As a result of that the golf club has a fixed club head. This is a drawback of the conventional golf club.

FIG. 3 is another conventional putter. The shaft 10 consists of a top shaft 11, and a bottom shaft 12 and the top shaft 11 is a hollow tube and the top end thereof is mounted with a grip 20. The interior of the grip 20 can be mounted with the shaft 10. The interior of the shaft 10 can hold the bottom shaft 12 and the bottom end of the bottom shaft 12 is then mounted with the club head 30. When the shaft 10 is retracted, the length of the shaft consists of the top shaft 11 and the bottom shaft 12 to allow putting of a golf ball. When the entire shaft is restored as shown in FIG. 4, which has the shortest length, the grip 20 is not provided with a flat surface 21 as that of FIG. 1. Due to the fact that the shaft 10 and the top shaft 11 are tubular shape, if the shafts 10, 11 are expanded after a retraction thereof, the relative position of the shaft 10 and the shaft 12 may have changed. If the grip 20 has a flat surface 21, the flat surface 21 may not be in alignment with the club head 30. As a result, the grip 20 of golf club is made into tubular shaped without a flat surface 21.

Accordingly it is an object of the present invention to provide an improved structure of a golf putter which can mitigate the above mentioned drawbacks.

SUMMARY OF THE INVENTION

Accordingly, it is an object of the present invention to provide an improved structure of a golf putter, wherein the club head of the putter can be changed.

An aspect of the present invention is to provide an improved structure of a golf putter comprising a shaft, an actuating seat having a threaded section, a fastening member and a club head, characterized in that the actuating seat has a top end provided with a holding hole of an appropriate depth to accommodate the shaft at the bottom end thereof, the lower end of the actuating seat is the threaded section to securely mount with the club head, the actuating seat has a center through hole and the fastening member is provided to the actuating seat so as to conveniently secure the seat to the fastening member, the fastening member passes through the through hole of the actuating seat and is mounted to the screw hole of the shaft, the club head has a hole which can be associated with the fastening member of the actuating seat so that the club head is mounted onto the actuating seat, thereby, the shaft, the actuating seat and the fastening member are formed integrally into an unit, the fastening member secures this unit together with the club head, by loosening the fastening member, the relative position of the shaft with respect to the actuating seat can be adjusted, that is, the relative angle of the club head and the shaft can be adjusted and then re-tightened the fastening member, and the function of the club head is changed.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
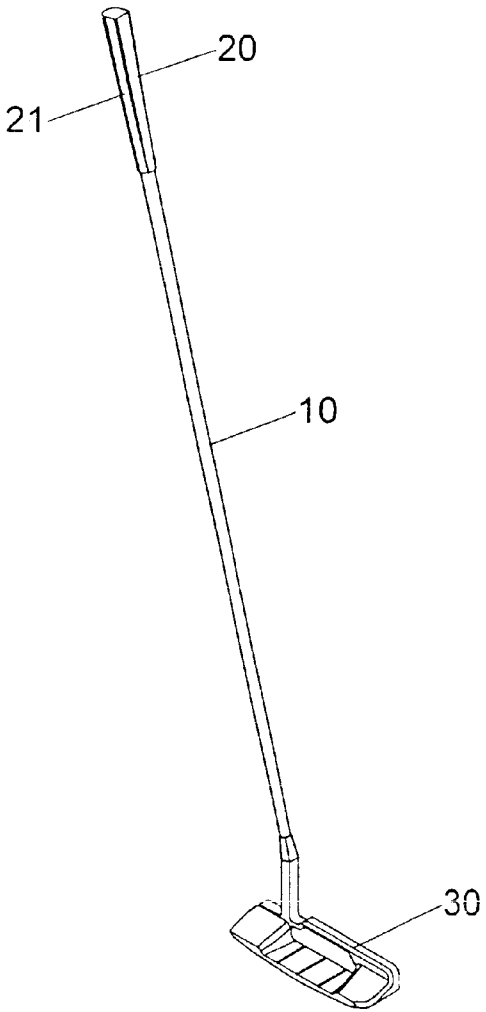
FIG. 1 is a perspective view of a conventional golf putter.
Figure 2:
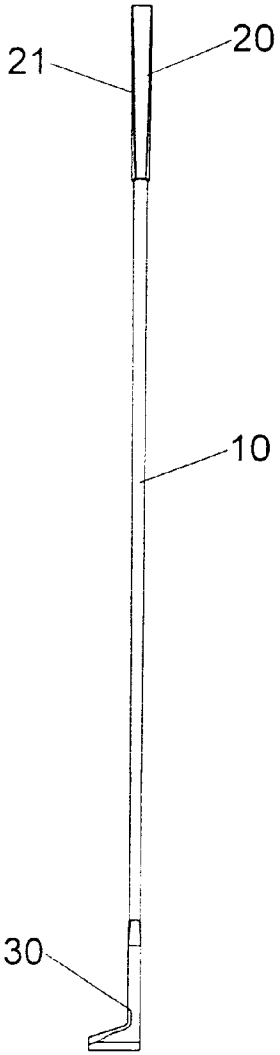
FIG. 2 is a side view of a conventional golf putter.
Figure 3:
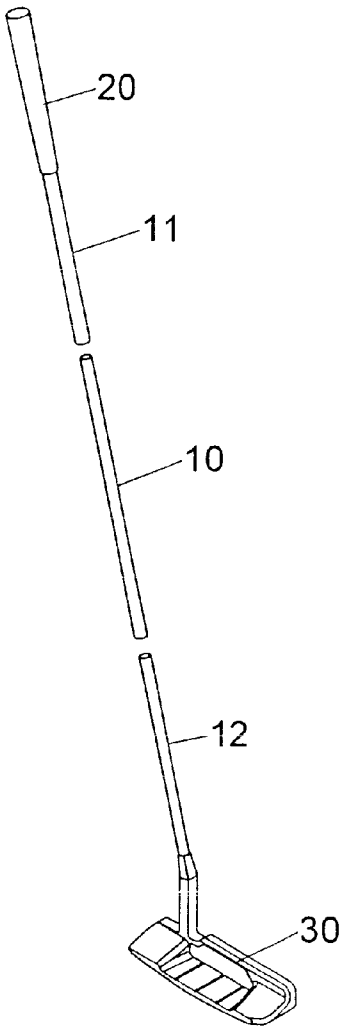
FIG. 3 is a perspective exploded view of a conventional golf putter.
Figure 4:
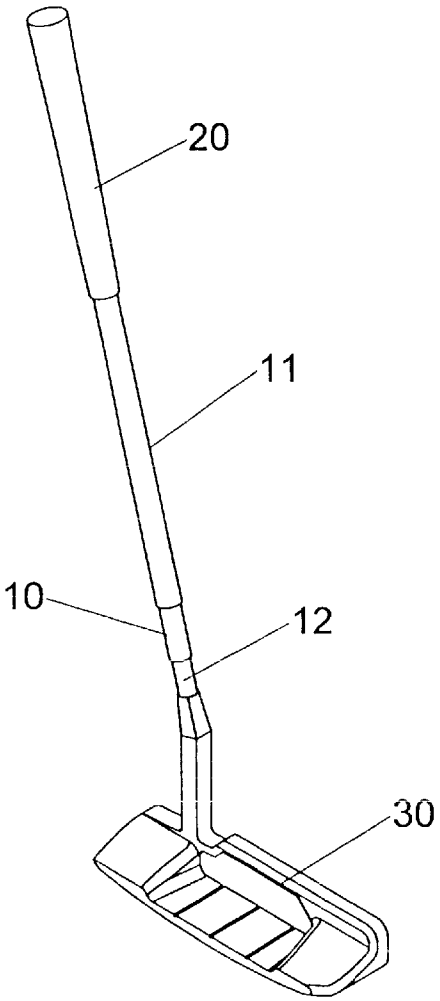
FIG. 4 is a retractable shaft of a conventional golf putter.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 5:
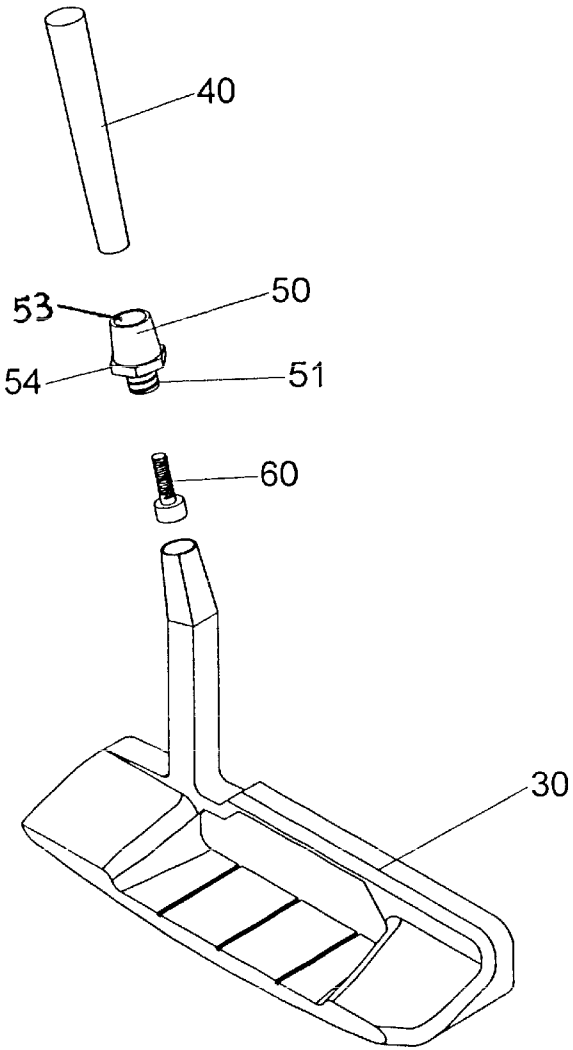
FIG. 5 is a perspective exploded view of a golf putter in accordance with the present invention.
Figure 6:
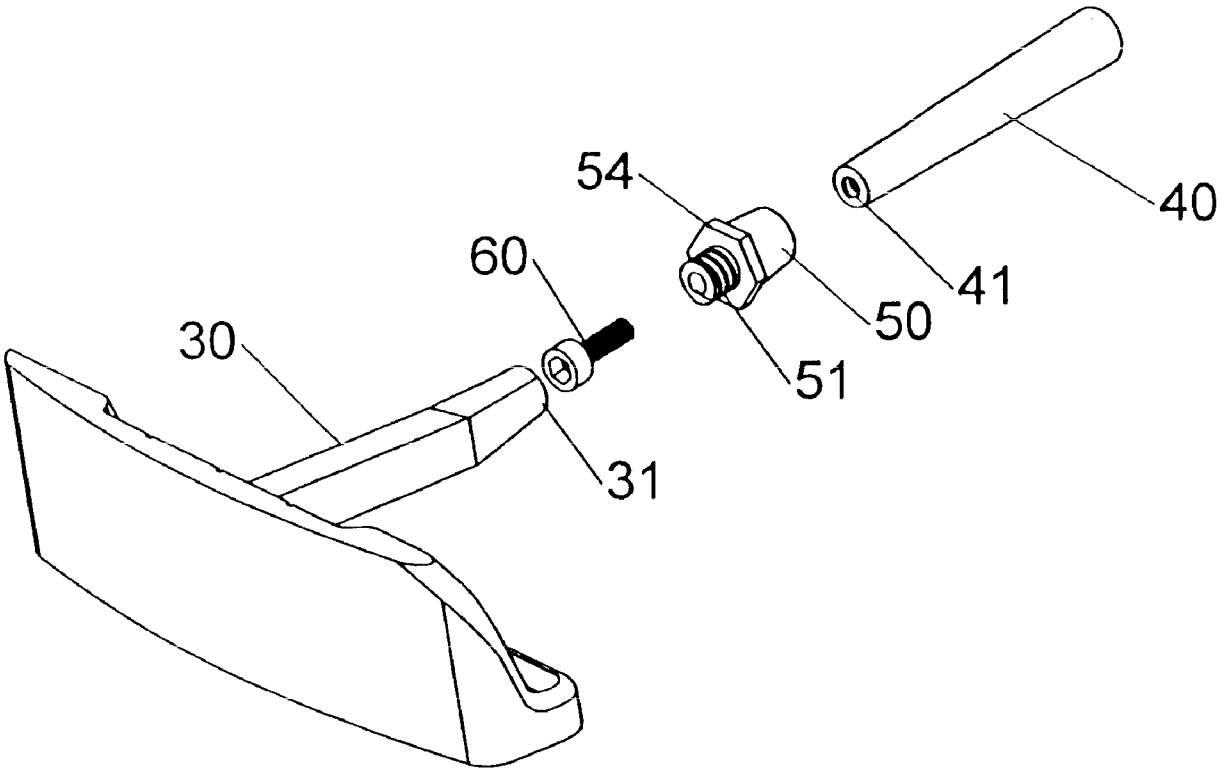
FIG. 6 is another perspective exploded view of a golf putter in accordance with the present invention.

Referring to FIGS. 5 and 6, there is shown a structure of a golf putter comprising a shaft 40, an actuating seat 50 having a threaded section 51, a fastening member 60 and a club head 30, characterized in that the actuating seat 50 has a top end provided with a holding hole 53 of an appropriate depth to accommodate the shaft 40 at the bottom end thereof, the lower end of the actuating seat 50 with the threaded section 51 to securely mount with the club head 30, the actuating seat 50 has a center through hole 52 and the fastening member 60 is provided to the actuating seat 50 so as to conveniently secure the seat 50 to the fastening member 60, the fastening member 60 passes through the through hole 52 of the actuating seat 50 and is mounted to the screw hole 41 of the shaft 40, the club head 30 has a hole which can be associated with the threaded section 51 of the actuating seat 50 so that the club head 30 is mounted onto the actuating seat 50, thereby, the shaft 40, the actuating seat 50 and the fastening member 60 are formed integrally into an unit, the fastening member 60 secures this unit together with the club head 30, by loosening the fastening member 60, the relative position of the shaft 40 with respect to the actuating seat 50 can be adjusted, that is, the relative angle of the club head 30 and the shaft 40 can be adjusted and then re-tightened the fastening member 60, and the function of the club head 30 is changed.

Figure 7:
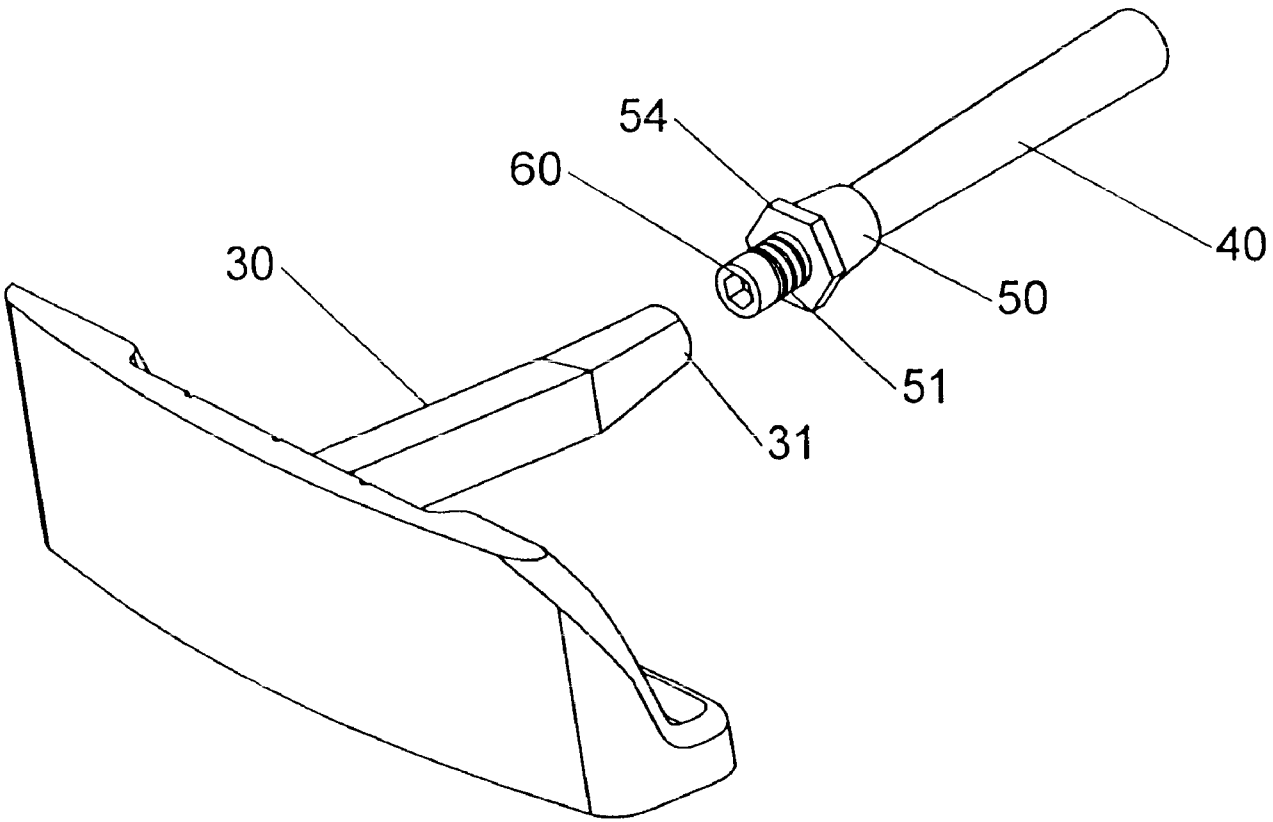
FIG. 7 is a perspective view showing the combination of the shaft portion of the putter in accordance with the present invention.
Figure 8:
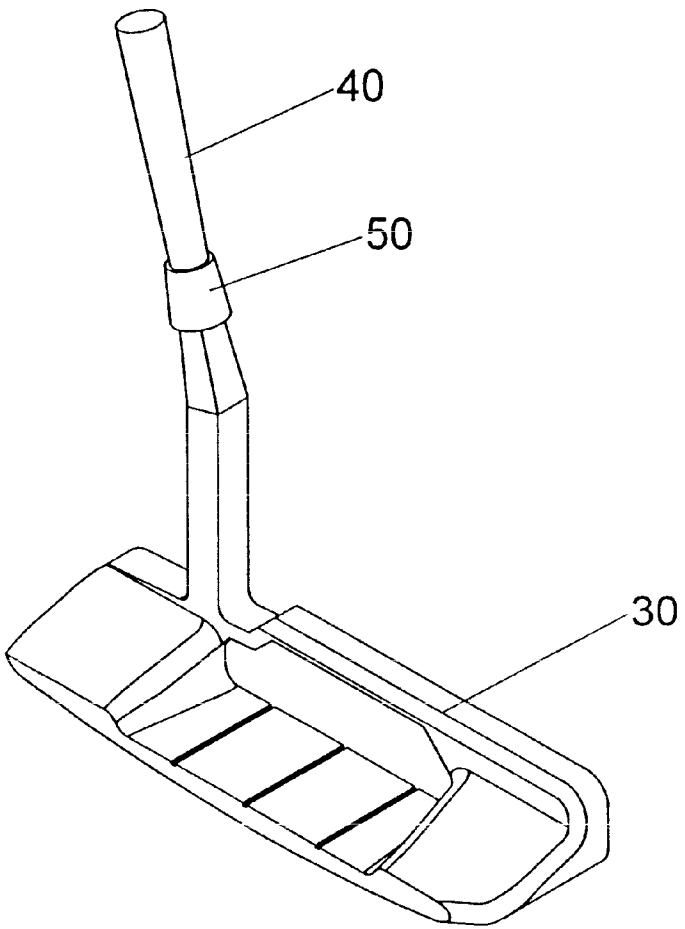
FIGS. 8 and 9 are perspective view of the putter in accordance with the present invention.
Figure 9:
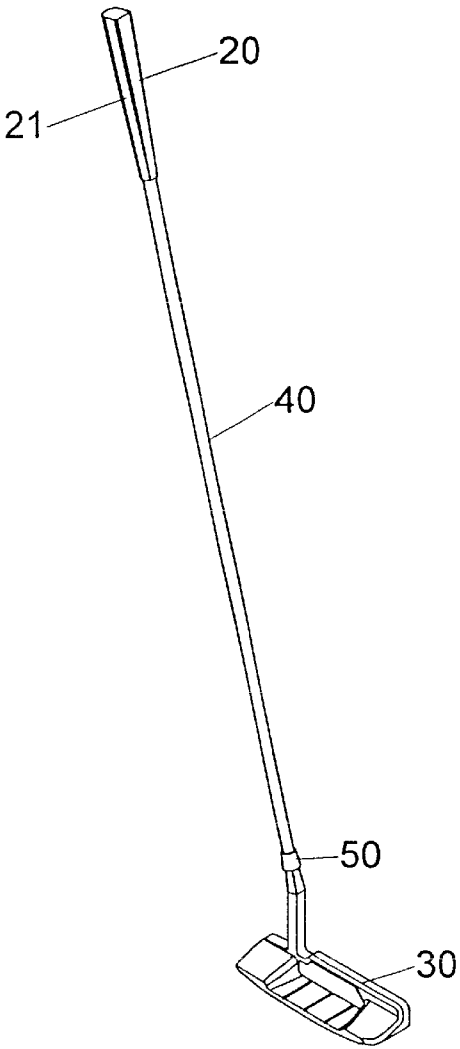

In accordance with the present invention, referring to FIG. 7, the fastening member 60 first passes through the through hole 52 of the actuating seat 50, and the fastening member 60 then drives the actuating seat 50 to mount at the screw hole 41 of the shaft 40. The actuating seat 50 is compressed in between the shaft 40 and the fastening member 60 such that the fastening member 60, the shaft 40 and the actuating seat 50 are mounted integrally as one unit. After that the threaded section 51 at the bottom end of the actuating seat 50 is mounted with the club head 30, the top end of the shaft 40 is mounted with a grip 20, and an improved structure of a golf putter, as shown in FIGS. 8 and 9, is obtained.

In accordance with the present invention, if the club head 30 is to be changed, the club head 30 and the actuating seat 50 are separated, and a second club head 30 is used. At this instance, the club head 30 may be not in alignment with the flat surface 21 of the grip 20. Then, the angle difference between the club head 30 and the grip 20 has to be remembered roughly. Then, the club head 30 is disengaged with the actuating seat 50, and the fastening member 60 is released, and the actuating seat 50 is then released. If the actuating seat 50 rotates, the relative position of the actuating seat 50 and the fastening member 60 can be adjusted. That is, the angle difference of the grip 20 and the club head 30 is adjusted. If the fastening member 60 is tightened further into the screw hole 41 of the shaft 40. The actuating seat 50 is mounted further in between the fastening member 60 and the shaft 40. Then, the relative angle of the actuating seat 50 and the shaft 40 is also changed. That is, the exact position of the club head 30 and the shaft 40 can be adjusted further. If accurate adjustment cannot be made, repeat the above procedures another or more time until the required adjustment is obtained.

In accordance with the present invention, the flat surface 21 of the grip 20 can also be adjusted. Based on the above-mentioned structure, a player may buy a shaft 40 and a plurality of club heads 30. In practice, the head 30 is connected to the shaft 40 when it is needed.

In accordance with the present invention, the shaft 40 may comprise a plurality of shaft sections, and the last section of the shaft 40 is mounted together with the grip 20 with the flat surface 21.

Figure 10:
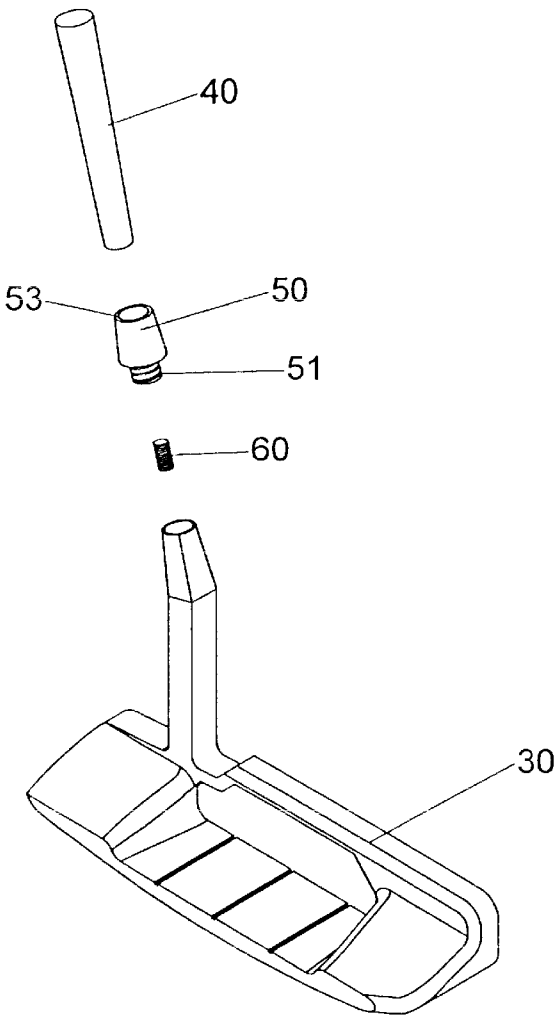
FIG. 10 is a perspective exploded view of a second preferred embodiment of the present invention.
Figure 11:
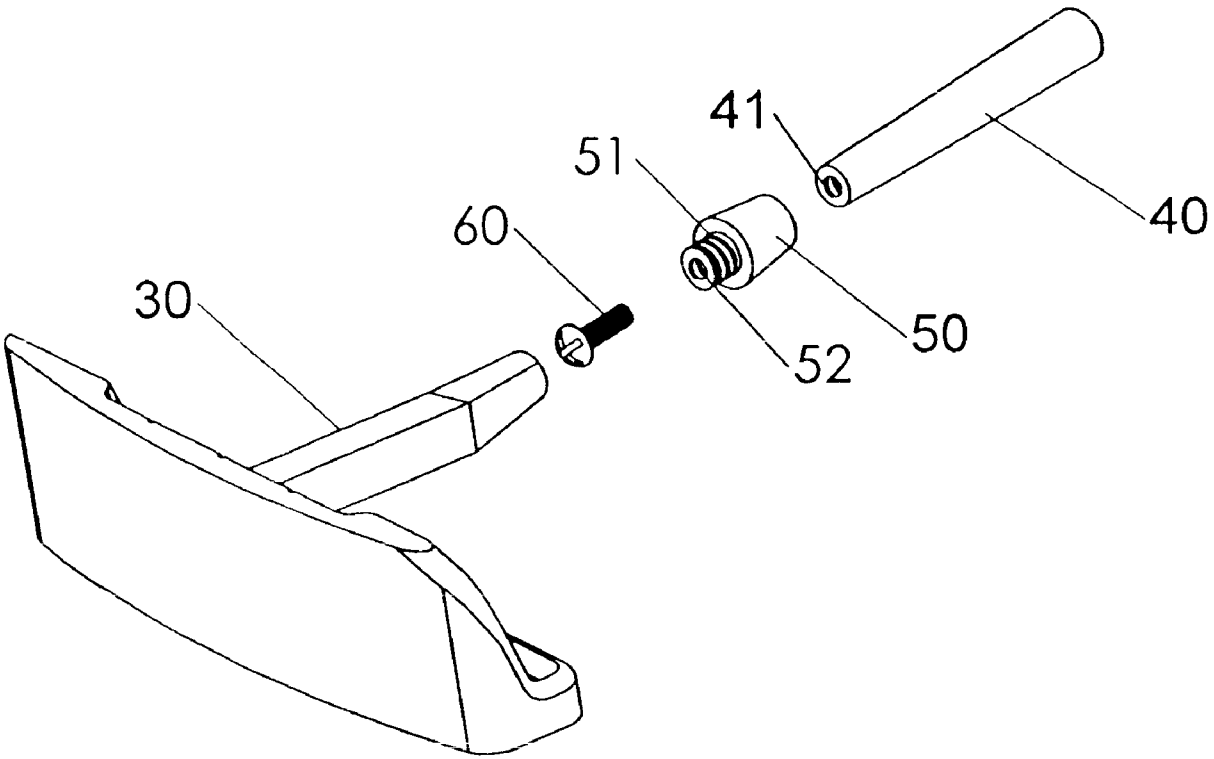
FIG. 11 is an exploded view of a second preferred embodiment of the present invention.

Referring FIGS. 10 to 11, there is shown a second preferred embodiment of one present invention. The through hole 52 of the actuating seat 50 is changed to a screw hole and the fastening member 60 is a screw 60, as shown in FIG. 10, or a bolt 60 as shown in FIG. 11.

Figure 12:
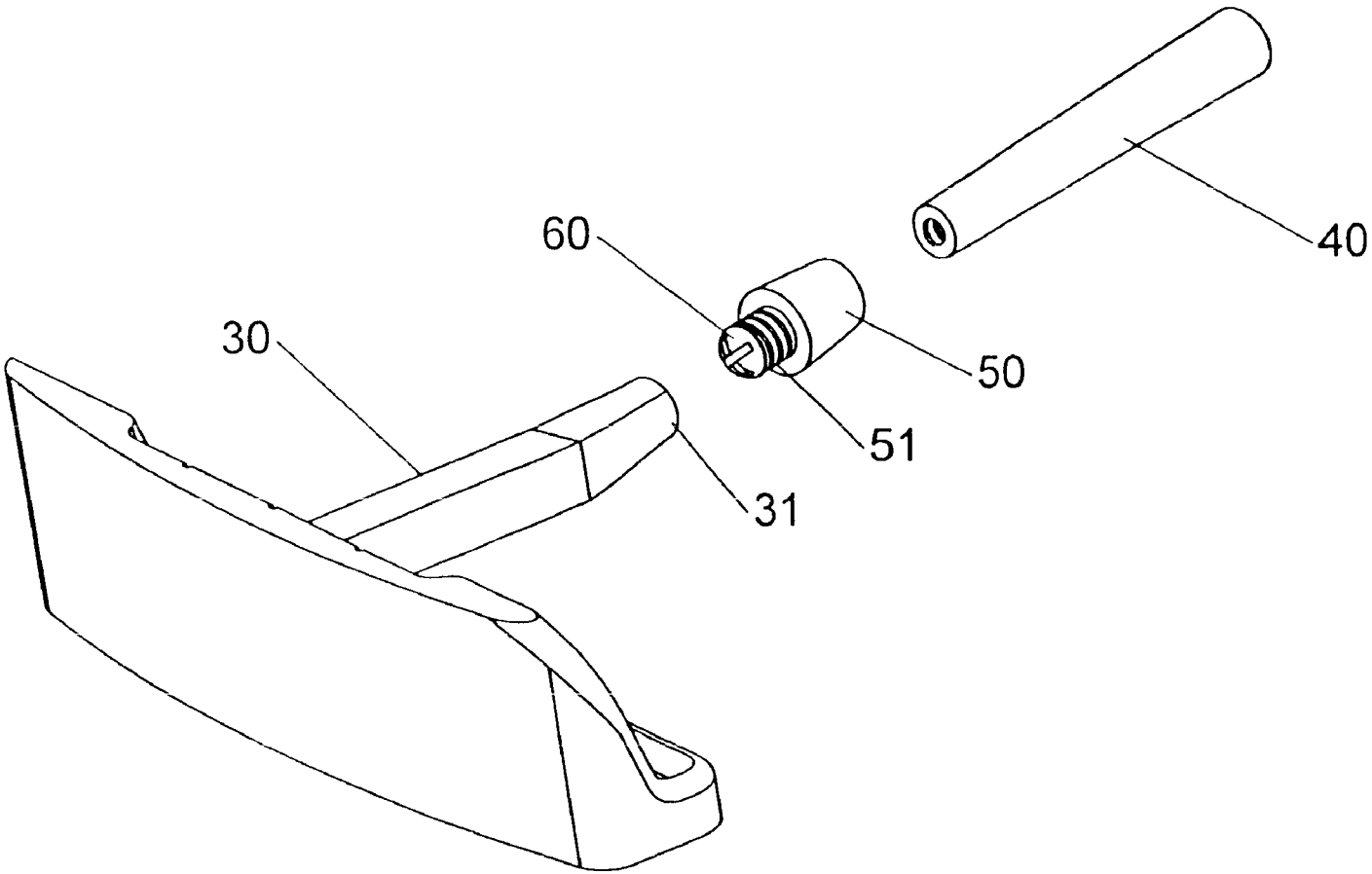
FIGS. 12 and 13 are perspective views, showing partial combined parts of the golf putter of the present invention.
Figure 13:
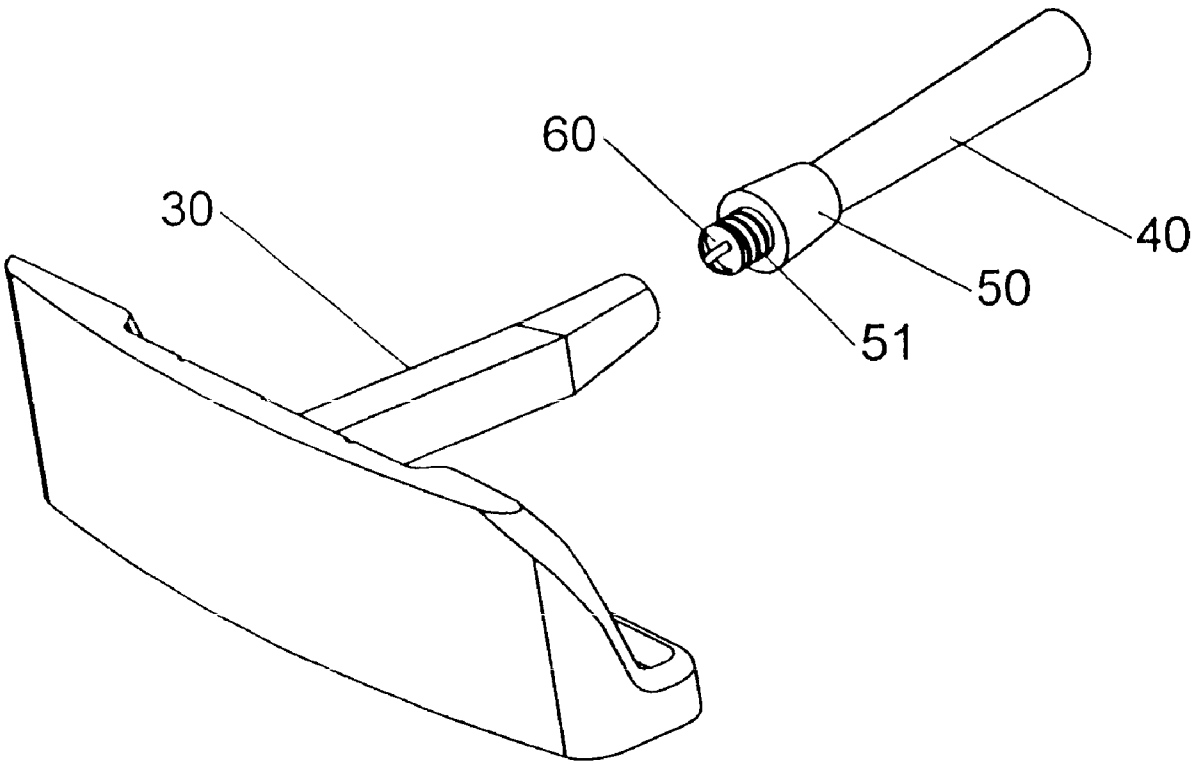

As shown in FIG. 12, the fastening member 60 is mounted to the screw hole 52 and the fastening member 60 drives the actuating seat 50 to mount on the screw hole 41, as shown in FIG. 13, the fastening member 60 secures the shaft 40, the actuating seat 50 to form as one unit. The threaded section 51 at the bottom end of the actuating seat 50 is used to mount with the club head 30, and the top end of the shaft 40 is then mounted with the grip 20. A golf putter, in accordance with the present invention, as shown in FIGS. 8 and 9, is obtained.

In accordance with the present invention, if the club head 30 is to be changed. The club head 30 and the actuating seat 50 are separated, and a second club head 30 is used. At this instance, the club head 30 may be not in alignment with the flat surface 21 of the grip 20. Then, the angle difference between the club head 30 and the grip 20 has to be remembered roughly. Then, the club head 30 is disengaged with the actuating seat 50, and the fastening member 60 is released, and the actuating seat 50 is then released. If the actuating seat 50 rotates, the relative position of the actuating seat 50 and the fastening member 60 can be adjusted. That is, the angle difference of the grip 20 and the club head 30 is adjusted. If the fastening member 60 is tightened further into the screw hole 41 of the shaft 40. The actuating seat 50 is mounted further in between the fastening member 60 and the shaft 40. Then, the relative angle of the actuating seat 50 and the shaft 40 is also changed. That is, the exact position of the club head 30 and the shaft 40 can be adjusted further. If accurate adjustment cannot be made, repeat the above procedures another or more time until the required adjustment is obtained.

Figure 14:
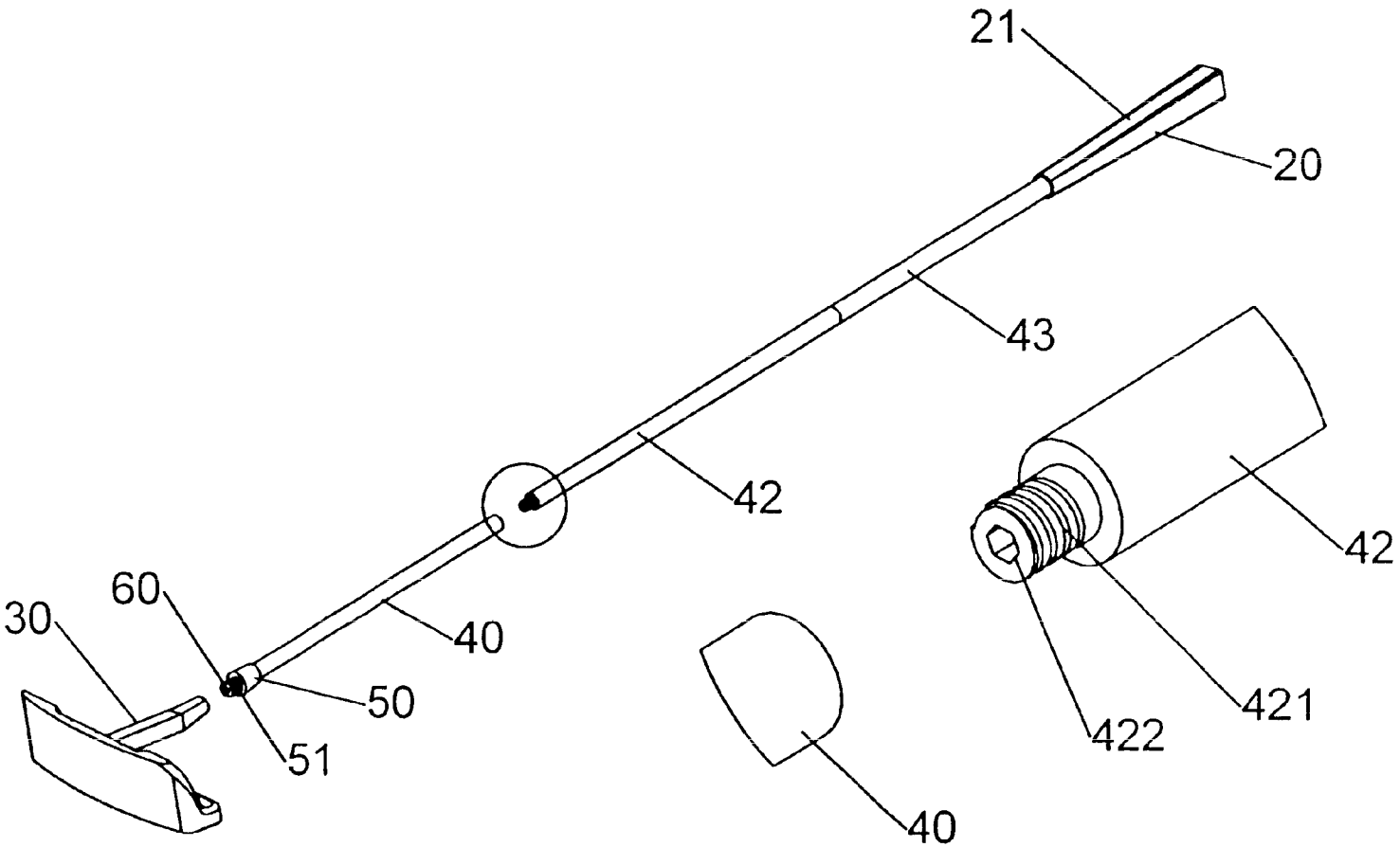
FIG. 14 is a perspective view of the shaft of the second preferred embodiment, wherein the shaft consists of a multiple shaft sections.

FIG. 14 is a second preferred embodiment in accordance with the present invention, wherein the shaft consists of a plurality of shaft sections 40, 42, 43. In accordance with the second preferred embodiment, the shaft sections are mounted by a screwing method. That is the shaft 42 is provided with threaded section 421, and the front end of the threaded section 421 is a hexagonal hole 422. In combination, the threaded section 421 of the shaft 42 is mounted with the shaft 40. Obviously, the end of the shaft 40 is provided with inner threads (not shown).

The hexagonal hole 422 allows a hexagonal wrench to separate the shaft section 42 from shaft section 43. The wrench is inserted into the hexagonal hole 422 and one hand holds the grip 20 and the other hand moves the wrench. In accordance with the present invention, the hexagonal hole 422 can be a cross-shaped hole to allow separation of shaft sections by means of a screwdriver.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A structure of a golf putter comprising a shaft, an actuating seat having a threaded section, a fastening member and a club head, wherein the actuating seat has a top end provided with a holding hole of an appropriate depth to accommodate the shaft at the bottom end thereof, the lower end of the actuating seat is the threaded section to securely mount with the club head, the actuating seat has a center through hole and the fastening member is provided to the actuating seat so as to conveniently secure the seat to the fastening member, the fastening member passes through the through hole of the actuating seat and is mounted to a screw hole of the shaft, the club head has a hole which can be associated with the fastening member of the actuating seat so that the club head is mounted onto the actuating seat, thereby, the shaft, the actuating seat and the fastening member are formed integrally into an unit, the fastening member secures this unit together with the club head, by loosening the fastening member, the relative position of the shaft with respect to the actuating seat can be adjusted, that is, the relative angle of the club head and the shaft can be adjusted and then re-tightened the fastening member, and the function of the club head is changed, and the shaft comprises a plurality of shaft sections.

* * * * *